United States Patent [19]

Smortchevsky

[11] 3,984,216

[45] Oct. 5, 1976

[54] METHOD FOR REMOVAL OF MATERIAL FROM THE COLLECTING PLATES OF ELECTROSTATIC PRECIPITATORS AND THE LIKE

[76] Inventor: John J. Smortchevsky, 1241 - 30th Ave., San Francisco, Calif. 94122

[22] Filed: Nov. 15, 1974

[21] Appl. No.: 523,991

[52] U.S. Cl. ..... 55/13; 55/96; 55/112; 55/304; 210/388

[51] Int. Cl.[2] ..... B03C 3/76

[58] Field of Search ..... 55/12, 13, 112, 113, 55/149, 300, 304, 96; 209/228; 210/388; 222/196

[56] References Cited

UNITED STATES PATENTS

| | | | |
|---|---|---|---|
| 2,123,464 | 7/1938 | Engelman | 55/112 |
| 2,788,859 | 4/1957 | Eron | 55/304 |
| 3,109,720 | 11/1963 | Cummings et al. | 55/13 |
| 3,140,016 | 6/1964 | Frazel | 222/196 |
| 3,653,185 | 4/1972 | Scott et al. | 55/112 X |
| 3,759,014 | 9/1973 | Brandt et al. | 55/13 |

FOREIGN PATENTS OR APPLICATIONS

| | | | |
|---|---|---|---|
| 458,872 | 8/1949 | Canada | 55/112 |
| 728,041 | 4/1955 | United Kingdom | 55/13 |
| 755,204 | 8/1956 | United Kingdom | 55/13 |

*Primary Examiner*—Frank W. Lutter
*Assistant Examiner*—David L. Lacey

[57] ABSTRACT

An improved method for effective removal of collected materials, such as dust and fly ash, from the collecting plates of electrostatic precipitators and the like which induces simultaneous axial and transverse vibratory motions in each collecting plate with substantial coincidence of the maximum accelerations associated with the two motions. A natural frequency of the axial vibration $2n$ times the natural frequency of the transverse vibration for values of $n$ in the range of 1 to 5 is most advantageous for material removal.

2 Claims, 2 Drawing Figures

Figure 1:
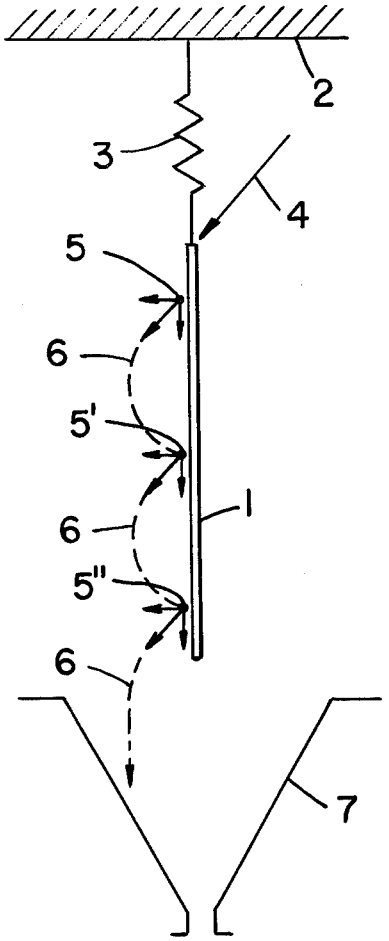

METHOD FOR REMOVAL OF MATERIAL FROM THE COLLECTING PLATES OF ELECTROSTATIC PRECIPITATORS AND THE LIKE

This invention relates to improvement in the removal of materials from the collecting plates of electrostatic precipitators and the like. This improvement is achieved by causing each collector plate to vibrate with vibratory motions that have certain direction and frequency relationships.

Electrostatic precipitators generally comprise an array of spaced vertically hanging steel collecting plates with corona wires distributed between them. A high voltage applied between the corona wires and the adjacent collecting plates in the order of 40,000 volts, for example, establishes an electrostatic field in the space between them. Stack gas particles, for example, conducted through the space between the plates are attracted to the collecting plates and collect on their surfaces. Collected material is shed or dislodged from the plates into a collection hopper by mechanically rapping the plates at intervals in time as a layer of stack gas particles builds up on their surfaces. Known rapping techniques are described in textbooks on electrostatic precipitators such as S. Oglesby's *A Manual of Electrostatic Precipitator Technology*, Southern Research Institute, Birmingham, Alabama, 1970, part 1, pp. 233–238.

None of the therein described systems recognizes the advantages which can be achieved by application to the collecting plates of simultaneous axial and transverse vibrations. The present invention is based upon the discovery that collected materials can be more effectively removed from the collecting plates by inducing simultaneous axial and transverse vibration in particular relationships.

The principal object of this invention is to provide a method for effective removal of industrial and other dust or fly ash from the collecting plates of electrostatic precipitators which achieves improved efficiency and a more economical design.

A further object of this invention is to provide a method for removing collected material wherein vibratory motions induced in the collecting plates are optimized with respect to direction and instantaneous timing.

Figure 2:
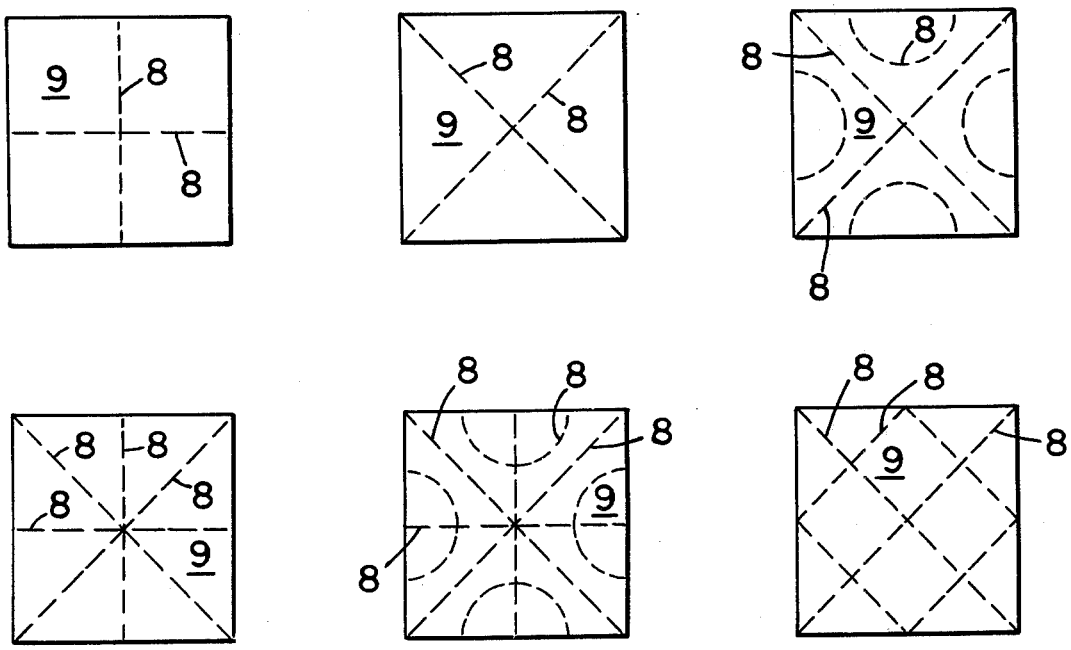

Other objects and advantages will become apparent upon consideration of the following description in connection with the drawing, wherein:

FIG. 1 is a diagramatic vertical end view of a typical electrostatic precipitator collecting plate that illustrates saltation of removed particles down the plate when one practices the described invention; and FIG. 2 illustrates examples of nodal lines on square plates which are obtainable by selection of the points of application of vibration and of damping.

FIG. 1 schematically illustrates a typical electrostatic collector plate 1 which has a natural frequency of transverse vibration equal to $f$. The illustrated plate and each of the others in the array within an electrostatic precipitator, for example, is suspended from a rigid support or frame 2 by elastic support means 3 (such as hanger rods, springs, spring washers, torsion bars or other devices), so that the support means 3 and plate 1 assembly has a natural frequency of axial vibration equal to F. For purposes of this description transverse vibration is horizontal in FIG. 1 or normal to the vertically hanging plate 1 and axial vibration is vertical.

Application of an intermittent rapping force to plate 1 causes two independent vibrations to begin: axial (due to elasticity of support means 3) and transverse (due to elasticity of the plate itself). These vibrations may be induced by means of known devices by separate vertical and horizontal rapping forces applied to each plate or to assemblies of plates, or by a single, vertical or oblique rapping force applied to the plates or assemblies as in 4, for example.

A particular particle of material 5, which is dislodged while the plate is vibrating, saltates downwardly on a trajectory 6 as shown schematically in dotted lines in FIG. 1 through positions 5' and 5'' into collecting hopper 7 for disposal or further processing. Saltation as illustrated is achieved only if the particle possesses two velocity components, horizontal and vertical, at the moment of its separation from the plate or the adjoining layer of dust or fly ash in addition to the effect of gravity. Presence of both velocity components at that moment is achieved by substantial quasi-synchronization in phase and frequency of the transverse and axial vibrations thus:

$$F = 2f$$

where $F$ is the frequency of axial vibrations in the vertical plane and $f$ is the frequency of transverse vibrations (i.e. normal or transverse to the collecting plate).

Theoretical derivation of this equation follows by considering first the transverse plate vibrations. When the plate deflects from its midposition to the left in FIG. 1, the particle of dust or fly ash will continue (due to its inertia) to move to the left while the plate motion decelerates as it approaches maximum deflection and then starts to the right. The particle of dust or fly ash 5, therefore, will separate from the plate or adjoining dust or fly ash layer at that instant in time or shortly after the plate passes through its midposition in moving to the left. The exact instant of separation depends on the attractive force between the plate and the particle, and on the magnitude of plate acceleration and deceleration during the vibratory motions.

Consider now the axial plate vibratons, and, specifically, the velocities associated with such vibrations. If the plate velocity is directed downwards at the instant of time when the particle separates as is described in the preceding paragraph, the particle also will have the same downward velocity. The particle 5 will fly with two velocity components: one nearly horizontal (due to transverse vibrations of the plate) and the other vertical (due to quasi-synchronized axial vibrations substantially in phase with the transverse vibrations). The effect of gravity is supplementary to that derived from the axial vibration.

To achieve saltation motion as illustrated in FIG. 1, it is necessary that the plate have a downward motion when the plate deflects to the left. Similarly, when the plate deflects to the right, the plate again has to be in a downward motion. Therefore, the plate must move through two complete vibratory periods in the axial direction while the plate moves through one complete period in its transverse vibratory motion. Thus, the equation is $F = 2f$. The vibrations are quasi-synchronized so that the maximum value of acceleration associated with the transverse vibratory motion (at maximum plate deflection) substantially coincides with a maximum value of acceleration associated with the axial vibratory motion.

Since the instant of separation of the dust or fly ash particle cannot be predicted precisely and quasi-synchronization in phase may be difficult to achieve in practice, the equation specified for this invention is generalized to the form:

$$F = 2nf$$

where $F$ and $f$ are frequencies of vibrations as stated above, and $n$ is a whole number in the range of 1 to 5.

In order to avoid frictional interference of detaching particles with the underlying particle layer, the peaks of trajectory 6 should at least be equal to the largest particle size. In most cases, that is about 100 microns. Even with this value, a significant portion of trajectory 6 would be subjected to the interference with underlying particles. Therefore, the peaks should probably be greater than 100 microns. Excessive peaks, however, are undesirable because of the danger of dust reentrainment in the gas stream, especially if the attractive forces to the plate diminish significantly with distance from the plate.

The transverse vibration of plates (i.e. normal) to their surface cannot be easily investigated by analytical methods. However, an experimental method developed by Chladni in the end of the 18th century demonstrates that plates tend to vibrate in patterns such as are shown in FIG. 2. Each panel 9 bordered by the nodal lines 8 vibrates separately, and each pattern is associated with its own natural frequency of vibration depending in part upon the points of force and damping application. FIG. 2 is illustrative only since an almost infinite variety of nodal patterns can be developed in the actual application of these principles to electrostatic precipitator plates.

The pattern of nodal lines of a precipitator collecting plate, if located across the plate, impedes downward flow of ash. Saltation, as shown in FIG. 1, is impractical from these lines because transverse velocity at the nodal lines is zero. Therefore, the collecting plates should be designed to minimize transverse nodal lines, or the damping points should be adjusted during rapping or otherwise to shift the nodal lines and thereby permit saltation of particles off the plates from as much surface area as is possible. Alternatively, rapping forces different in direction, magnitude or location can be applied during operation of the precipitator to shift the nodal lines.

To insure that the peaks of transverse vibration substantially coincide with the peaks of axial vibration, it is necessary that both amplitudes be quasi-synchronized. This is achieved automatically if both vibrations start from zero amplitude at essentially the same instant such as when both vibrations are initiated from the same rapper impact. The vibrations of plates should continue for as long after rapper impact as is possible to assist particles in moving downward as shown in FIG. 1. This makes it necessary to introduce as little damping to the natural plate vibrations as is possible.

Vibration of the plates can be induced by any means including the various types of rappers used in the industry at this time to which reference is made above providing that the natural frequencies generated in such vibrations are properly related. Proper simultaneous axial and transverse vibrations can also be achieved if a single source of vibrations is used. The general procedure for application of this method includes the determination of fundamental natural frequencies of the plates to be used in an actual installation and the matching of plate support natural frequencies in the proper ratio by introducing appropriate elastic elements into the support means 3.

The described method, therefore, (1) achieves effective dust or fly ash detachment by simultaneous transverse and axial plate vibrations, (2) minimizes the reentrainment of dust or fly ash in the gas stream because of the downward velocity component imparted to each detached particle, and (3) expedites dust or fly ash descent by augmenting particle free fall with the imparted downward velocity component.

It should be understood that the specific embodiments described herein are for illustrative purposes only, and that various modifications to them will be apparent to those skilled in the art. The illustrative embodiments are given to demonstrate the principles which constitute the scope of the invention defined in the appended claims.

I claim:

1. A method for removing particles of material collected upon vertical electrostatic precipitator collecting plates comprising the steps of:

inducing in each of said plates an axial vibratory motion; and simultaneously inducing in each of said plates a transverse vibratory motion wherein the maximum value of acceleration imparted to each particle by said transverse vibratory motion substantially coincides with a maximum downward value of acceleration imparted to each particle by said axial vibratory motion wherein the relationship of the frequency ($F$) of the axial vibratory motion to the frequency ($f$) of the transverse vibratory motion is $F=2nf$ and $n$ is a whole number within the range of 1 to 5.

2. The method of claim 1 wherein any transverse nodal lines developed by said transverse vibratory motion are shifted to permit particle saltation.

* * * * *